US012729880B2

(12) United States Patent
Andrew et al.

(10) Patent No.: US 12,729,880 B2
(45) Date of Patent: Sep. 8, 2026

(54) LEAK DETECTION SYSTEMS FOR A FLUID HEATING DEVICE

(71) Applicant: Rheem Manufacturing Company, Atlanta, GA (US)

(72) Inventors: Nathan Oliver Andrew, Auburn, AL (US); Arthur Young Hinton, Pike Road, AL (US); Troy Edward Trant, Montgomery, AL (US); Jason A. Steinbaum, Auburn, AL (US); Nicholas K. Nicholson, Selma, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 411 days.

(21) Appl. No.: 18/321,669

(22) Filed: May 22, 2023

(65) Prior Publication Data

US 2023/0375227 A1 Nov. 23, 2023

Related U.S. Application Data

(60) Provisional application No. 63/366,270, filed on Jun. 13, 2022, provisional application No. 63/365,139, filed on May 23, 2022.

(51) Int. Cl.
*F24H 15/12* (2022.01)
*F24H 9/17* (2022.01)

(52) U.S. Cl.
CPC ..... *F24H 15/12* (2022.01)

(58) Field of Classification Search
CPC .. F24H 9/16; F24H 9/17; F24H 15/12; G01M 3/042; G01M 3/156
See application file for complete search history.

(56) References Cited

U.S. PATENT DOCUMENTS

| | | | | |
|---|---|---|---|---|
| 5,188,143 | A * | 2/1993 | Krebs | F24H 15/12 126/388.1 |
| 6,175,310 | B1 * | 1/2001 | Gott | G01M 3/165 73/40 |
| 2009/0284382 | A1 * | 11/2009 | Hill | G01M 3/165 340/604 |
| 2019/0145662 | A1 * | 5/2019 | Gardner | B65D 90/24 122/507 |
| 2021/0190625 | A1 * | 6/2021 | Weitherspoon | G01M 3/002 |

* cited by examiner

*Primary Examiner* — Steven S Anderson, II
(74) *Attorney, Agent, or Firm* — Eversheds Sutherland (US) LLP

(57) ABSTRACT

The disclosed technology includes a leak detection system for a fluid heating device, the leak detection system including: a structure configured to at least partially insert into a portion of a fluid heater; a fluid removing portion of or in contact with the structure, the fluid removing portion configured to transport water from the structure to at least one leak sensor; and the at least one leak sensor configured to detect the fluid transported from the structure by the fluid removing portion.

16 Claims, 13 Drawing Sheets

LEAK DETECTION SYSTEMS FOR A FLUID HEATING DEVICE

CROSS-REFERENCE TO RELATED PATENT APPLICATION(S)

This application claims the benefit of U.S. Provisional Application No. 63/365,139, filed May 23, 2022, and of U.S. Provisional Application No. 63/366,270, filed Jun. 13, 2022, both disclosures of which are incorporated by reference as set forth in full.

FIELD OF THE DISCLOSURE

The present disclosure relates generally to fluid heating devices (e.g., water heaters), and more particularly to leak detection systems in fluid heating devices.

BACKGROUND

A fluid heating device (e.g., water heater) can deteriorate over the course of its life. The deterioration can compromise the integrity of the fluid heating device and/or cause water that is stored within the fluid heating device to leak. If left undetected and/or unattended, leaks can result in damage to the building in which the fluid heating device is located, furniture, electrical equipment, the fluid heating device itself, and/or other property, which in turn can result in costly repairs. Some leak sensors are provided as a separate accessory that a person must manually install on site rather than being integrated into the fluid heating device. However, some existing leak detection systems are slow and inefficient and are limited to detecting leaks where the leak sensors can be installed on an existing fluid heating system.

In light of the above mentioned shortcomings of the conventional fluid heating devices, there is a need for an improved leak detection system in fluid heating devices.

SUMMARY

These and other problems can be addressed by embodiments of the technology disclosed herein. The disclosed technology relates to fluid heating devices (e.g., water heaters), and more particularly to leak detection systems in fluid heating devices. The leak detection systems can be integrated into a corresponding fluid heating device during manufacturing of the fluid heating device, which can ensure proper installation and obviate the need for a customer to modify the fluid heating device.

The leak detection system can include a rigid structure configured to at least partially insert into the bottom pan of a water heater. The leak detection system can include a wicking material (e.g., a fluid removing portion). The wicking material can be substantially flat. Alternatively or in addition, the wicking material can extend along substantially all of the circumference of the water heater (e.g., the circumference of the bottom pan). The wicking material can be attached to the rigid structure along a circumference of the rigid structure, and the rigid structure can include a port. The port can be configured to at least partially receive a plug that is in electrical communication with a leak sensor. The plug can include one or more prongs that, when installed, insert into or otherwise contact the wicking material. The rigid structure can have a topography that slopes in a downward and radially outward direction such that water is guided toward the outer perimeter of the rigid structure. The perimeter may correspond to a variety of shapes not limited to a cylindrical shape with a circular perimeter. The rigid structure can include holes in a bottom surface of the rigid structure to permit ingress of water from the bottom pan.

Alternatively or in addition, the wicking material can be attached directly to the bottom pan (e.g., without the rigid structure). The leak detection system can include one or more attachment structures. The attachment structures can include a body having one or more prongs extending outwardly from a surface of the body. The prong can include a barb or hook (e.g., at an end of the prong). The prong(s) can be configured to extend at least partially into the wicking material to retain the wicking material at a desired position relative the bottom pan, and if present, the barb or hook can help to retain the wicking material on the prong. The attachment structure can include a hole extending through the body (e.g., to receive or pass a screw for attaching the bottom pan to the jacket). The attachment structure can include an overhang portion. The overhang portion can have a bottom surface configured to about a top surface of the sidewall of the bottom pan. As such, the attachment structure can be configured to hang from the top edge of the sidewall of the bottom pan.

Alternatively or in addition, the wicking material can have a first portion configured to extend into the bottom pan (e.g., along an inner surface of the sidewall of the bottom pan) and a second portion configured to extend along a portion of the outer surface of the jacket. The wicking material can have a height that is greater than the height of the bottom pan (e.g., greater than a height of the sidewall of the bottom pan). The leak sensor can be located at an internal location within the water heater and can contact the first portion of the wicking material. Alternatively, the leak sensor can be located at an external location of the water heater and can contact the second portion of the wicking material.

According to one aspect of the present disclosure, a leak detection apparatus for a water heater is disclosed. The leak detection apparatus includes a circular band having a first end and a second end defining an arcuate length therebetween. The circular band includes an inner surface configured for conformance with an outer surface of an outer jacket of the water heater. The leak detection apparatus further includes a protrusion extending from the inner surface of the circular band along a radial axis and configured to receive water leaking from a tank of the water heater. The leak detection apparatus further includes a sensor disposed in the protrusion and configured to generate a signal indicative of water present in the protrusion.

In some embodiments, the first end and the second end of the circular band are disposed 90 degrees apart. In some embodiments, the protrusion has a length less than a radial length of an insulation space defined between the tank and the outer jacket of the water heater.

In some embodiments, the protrusion is defined at a center of the arcuate length of the circular band.

In some embodiments, the protrusion includes a body having a cavity configured to accommodate the sensor therein.

In some embodiments, the circular band includes a through hole configured to communicate with the cavity of the one or more protrusions.

In some embodiments, the circular band is made of a plurality of ring bodies, wherein each ring body comprises at least one of the one or more protrusions.

In some embodiments, each ring body includes a first end and a second end defining an arcuate length, and wherein the first end and the second end of the ring body are disposed at 90 degrees apart.

In some embodiments, the one or more openings of the outer jacket have a cross sectional shape identical to a cross sectional shape of the one or more protrusions.

In some embodiments, the leak detection apparatus is disposed proximate a bottom end of the water heater.

In some embodiments, the circular band includes a through hole configured to communicate with the cavity of the protrusion.

In some embodiments, the inner surface of the circular band includes a first surface configured to fluid tightly abut the outer surface of the outer jacket and a second surface extending at an offset distance from the first surface. The second surface of the circular band and the outer surface of the outer jacket are together configured to define a gap therebetween to receive water leaking from outside the outer jacket.

In some embodiments, the protrusion extends from the first surface of the circular body and is configured to receive water passing though the gap between the outer jacket and the circular band.

According to another aspect of the present disclosure, a water heater is disclosed. The water heater includes a tank configured to contain water, an outer jacket disposed around the tank, and a leak detection apparatus disposed around the outer jacket. The outer jacket is configured to insulate the tank. The leak detection apparatus includes a circular band having an inner surface defined in conformance with an outer surface of the outer jacket.

The leak detection apparatus further includes one or more protrusions extending from the inner surface of the circular band along a radial axis. The one or more protrusions extend through one or more corresponding openings defined in the outer jacket and are configured to receive water leaking from the tank. The leak detection apparatus further includes a sensor disposed in the one or more protrusions and configured to generate a signal indicative of water present in the one or more protrusions.

In some embodiments, the inner surface of the circular band includes a first surface configured to fluid tightly abut the outer surface of the outer jacket and a second surface extending at an offset distance from the first surface. The second surface of the circular band and the outer surface of the outer jacket together define a gap there between to receive water leaking from outside the outer jacket.

In some embodiments, the one or more protrusions extend from the first surface of the circular band into an insulation space defined between the tank and the outer jacket through the openings of the outer jacket and configured to receive water passing though the gap between the outer jacket and the circular band.

In some embodiments, the protrusion has a length less than a radial length of the insulation space defined between the tank and the outer jacket of the water heater.

In some embodiments, the protrusion is a hollow body having a cavity and is configured to accommodate the sensor therein.

In some embodiments, the circular band includes a through hole configured to communicate with the cavity of the one or more protrusions.

In some embodiments, the circular band is made of a plurality of ring bodies, wherein each ring body comprises at least one of the one or more protrusions.

In some embodiments, each ring body includes a first end and a second end defining an arcuate length, and wherein the first end and the second end of the ring body are disposed at 90 degrees apart.

In some embodiments, the one or more openings of the outer jacket have a cross sectional shape identical to a cross sectional shape of the one or more protrusions.

In some embodiments, the leak detection apparatus is disposed proximate a bottom end of the water heater.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

A better understanding of embodiments of the present disclosure (including alternatives and/or variations thereof) may be obtained with reference to the detailed description of the embodiments along with the following drawings.

DETAILED DESCRIPTION

Figure 1A:
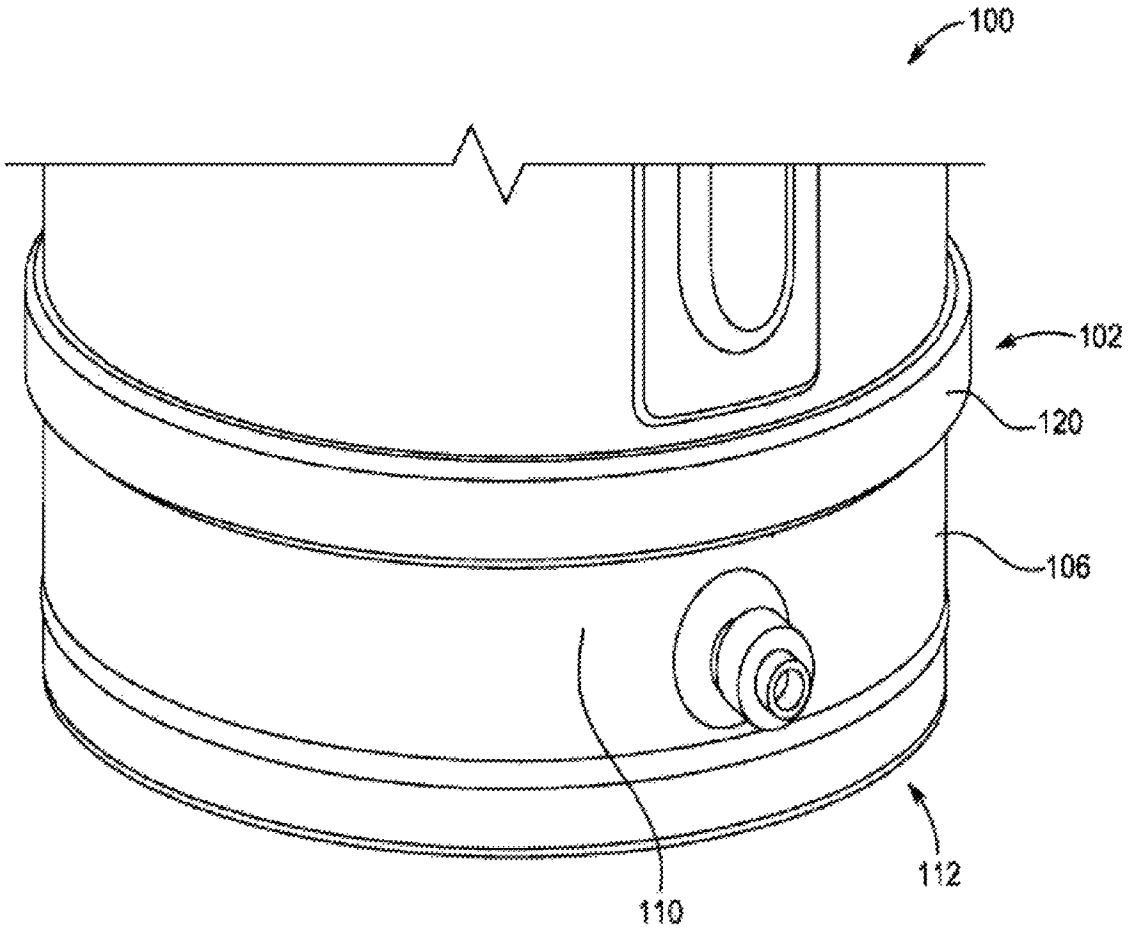
FIG. 1A is an enlarged perspective view of a bottom portion of a water heater showing a leak detection apparatus.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. Accordingly, when the present disclosure is described as a particular example or in a particular context, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Leak detection in fluid heating devices may include the use of sensors to detect the presence of fluid where it should not be, and/or amounts of fluid that are more than acceptable amounts. Fluid heating devices often allow for add-on leak detection sensors, and some fluid heating devices may be manufactured with integrated leak detection sensors, but there is a need for 360-degree leak detection in fluid heating devices. For example, the ability of a leak detection cable to detect leaks may be limited to where the cable or a wicking material is placed.

There is therefore a need for leak detection that pulls water from all the way around a fluid heating device so that leaks can be detected even when the leak detection sensor is not positioned where the leak occurs.

Figure 1B:
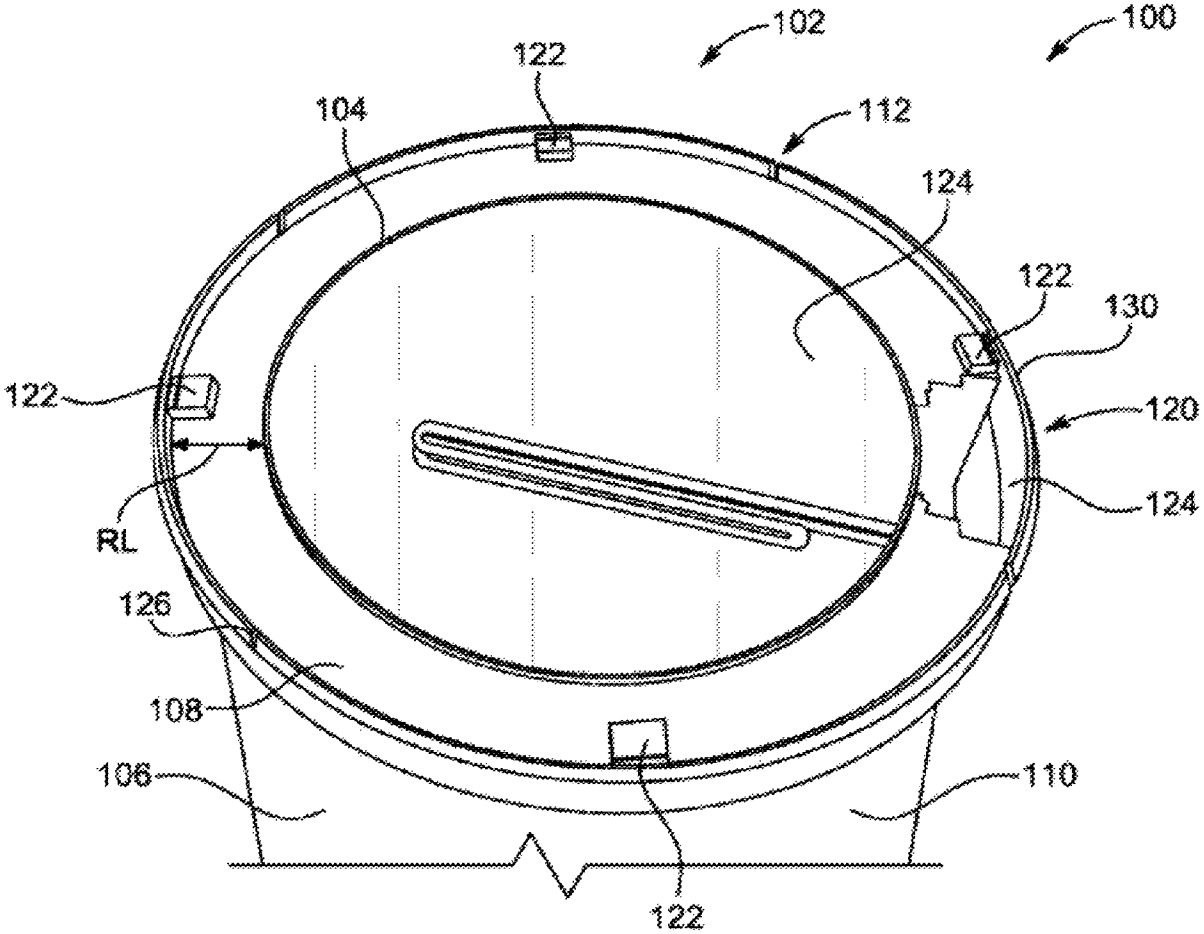
FIG. 1B is a cross-sectional perspective view of the water heater showing the leak detection apparatus.

Referring to FIG. 1A, an enlarged perspective view of a bottom portion of a water heater 100 having a leak detection apparatus 102 is illustrated, according to an embodiment of the present disclosure. Referring to FIG. 1B, a bottom perspective view of the water heater 100 is illustrated, according to an embodiment of the present disclosure. As seen in FIG. 1B, a bottom plate of the water heater 100 is removed to illustrate placement of the leak detection apparatus 102 in the water heater 100. As shown in FIG. 1A and FIG. 1B, the water heater 100 includes a tank 104 configured to contain water. The tank 104 is fluidly coupled with one or more water source(s) to receive water therein and one or more supply port(s) to discharge water as demanded by user via inlet conduits and outlet conduits, respectively. The water heater 100 further includes an outer jacket 106 disposed around the tank 104 and configured to insulate the tank 104. The water heater 100 further includes the leak detection apparatus 102 which is disposed around the outer jacket 106. The water heater 100 has an insulation space 108 defined around the tank 104. Particularly, the outer jacket 106 is disposed around the tank 104 and is spaced apart from the tank 104 such that the insulation space 108 is formed between the tank 104 and the outer jacket 106. In an embodiment, insulation materials such as foam may be filled within the insulation space 108 to further improve operational efficiency of the water heater 100.

In an embodiment, the leak detection apparatus 102 is disposed around an outer surface 110 of the outer jacket 106. If the leak detection apparatus 102 is placed in an area where moisture cannot travel or accumulate, then the leak detection apparatus 102 may not be able to collect and transport moisture and/or water and hence may not function as intended. The placement of the leak detection apparatus 102 may also depend on type of the tank 104 being monitored for leak detection as construction and operation could impact placement effectiveness. In an embodiment, the leak detection apparatus 102 may be placed anywhere on the outer surface 110 of the outer jacket 106. In a non-limiting example, the leak detection apparatus 102 is disposed proximate a bottom end 112 of the water heater 100. In some embodiments, the leak detection apparatus 102 may be placed at multiple locations on the water heater 100. The placement locations may be chosen depending on various factors including, but not limited to, size and shape of the tank 104 being monitored, heating capacity of the water heater 100, and applications of the water heater 100.

The leak detection apparatus 102 includes a circular band 120 and one or more protrusions 122 extending from the circular band 120. The circular band 120 includes an inner surface 124 and an outer surface 126. Preferably, the inner surface 124 of the circular band 120 is defined in conformance with the outer surface 110 of the outer jacket 106. The one or more protrusions 122 of the leak detection apparatus 102 extend from the inner surface 124 of the circular band 120 along a radial axis 'R' of the water heater 100. The radial axis 'R' may be defined as an axis line that passes along a diametric line of the water heater 100. In certain embodiments, the one or more protrusions 122 (e.g., fluid removing portions) extend through one or more corresponding openings 302 (shown in FIG. 3) defined in the outer jacket 106 of the water heater 100 and into the insulation space 108 formed between the tank 104 and the outer jacket 106. The one or more protrusions 122 extending from the inner surface 124 of the circular band 120 is configured to receive water leaking from the tank 104 and the outer jacket 106.

In an embodiment, the circular band 120 is made of a plurality of ring bodies 130. As shown in FIG. 1B, each of the plurality of ring bodies 130 may be placed adjacent to each other to form the circular band 120 around the outer jacket 106. In some embodiments, each of the plurality of ring bodies 130 may be coupled each other to form the circular band 120. For the illustration purpose of the present disclosure, the terms 'circular band 120' and 'ring body 130' may be used interchangeably unless otherwise specifically mentioned for the clarity in the explanation thereof.

Figure 2A:
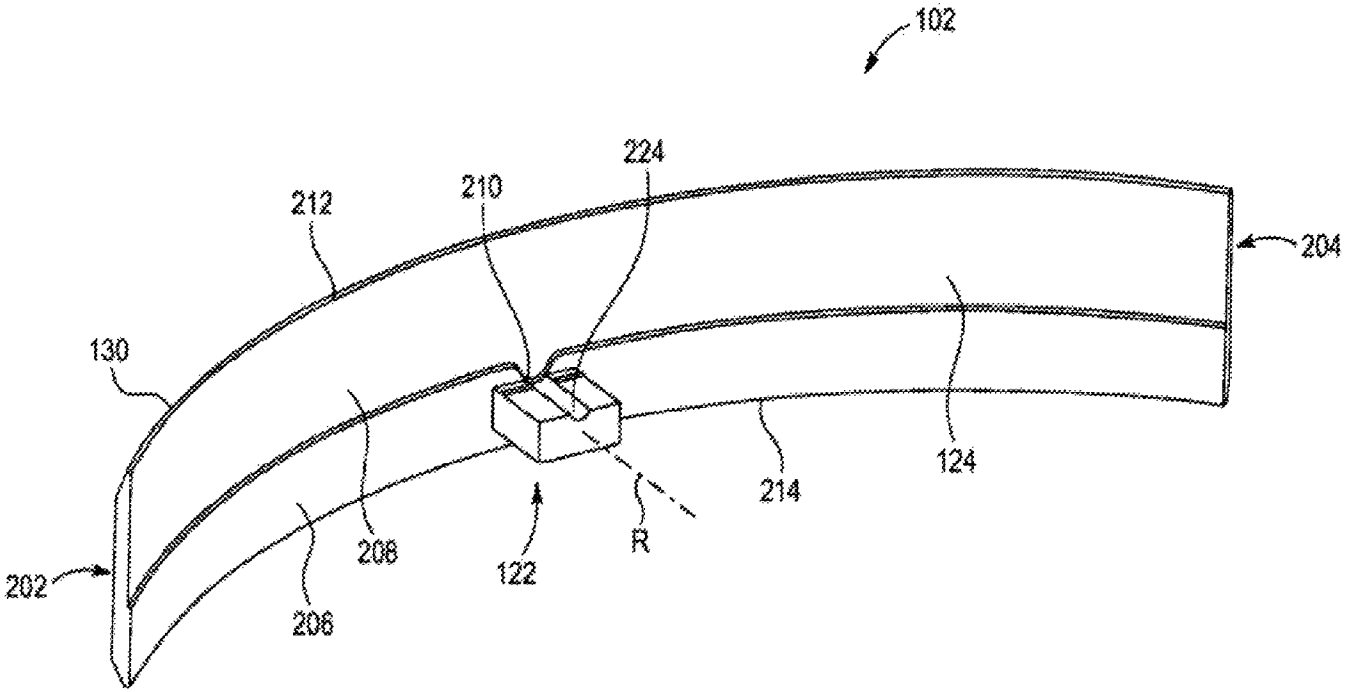
FIG. 2A is an inner perspective view of a ring body of the leak detection apparatus.
Figure 2B:
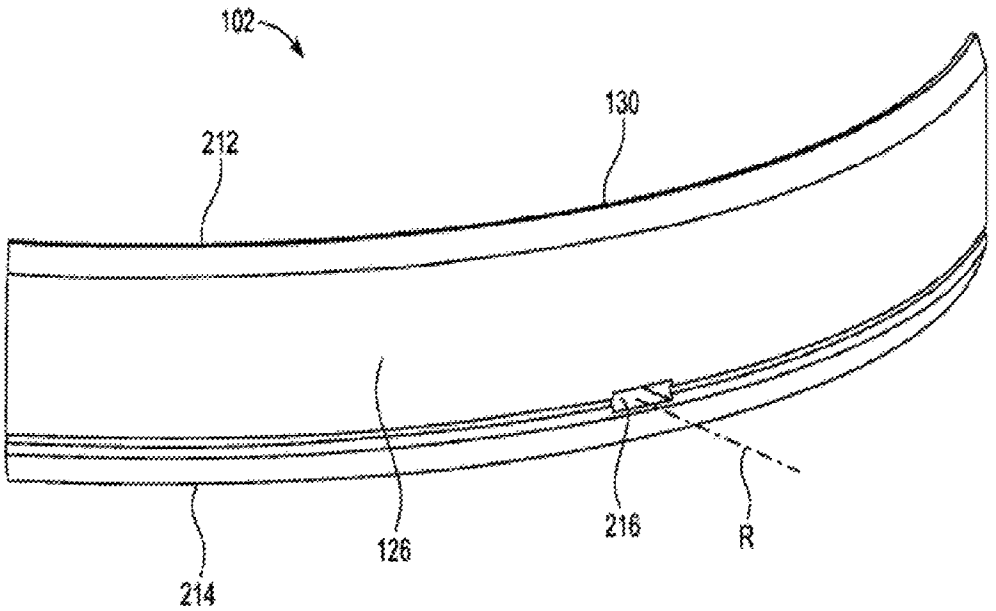
FIG. 2B is an outer perspective view of the ring body of the leak detection apparatus.

Referring to FIG. 2A and FIG. 2B, an inner perspective view and an outer perspective view, respectively, of the ring body 130 of the leak detection apparatus 102 is illustrated, according to various embodiments of the present disclosure. A plurality of such ring bodies 130, shown in FIG. 2A, may together form the circular band 120 around the outer jacket 106 of the water heater 100. Each ring body 130 includes a first end 202 and a second end 204 defining an arcuate length. In one embodiment, the first end 202 and the second end 204 of each ring body 130 is defined at 90 degrees apart, such that four ring bodies 130 may be connected to form the circular band 120. In some embodiments, the first end 202 and the second end 204 of each ring body 130 may be defined at 180 degrees apart, such that two ring bodies 130 may be connected to form the circular band 120. The plurality of ring bodies 130 is disposed around the outer surface 110 of the outer jacket 106 and extends along a perimeter of the outer jacket 106 to form the circular band 120. In particular, each ring body 130 includes the inner surface 124 and the outer surface 126. The inner surface 124 of each ring body 130 is defined in conformance with the outer surface 110 of the outer jacket 106 of the water heater 100 and extends along a portion of the perimeter of the outer jacket 106.

As shown in FIG. 2A, the inner surface 124 of the ring body 130 includes a first surface 206 and a second surface 208. The first surface 206 and the second surface 208 of the ring body 130 are defined in conformance with the outer surface 110 of the outer jacket 106. Particularly, the first surface 206 is configured to fluid-tightly engage with the outer surface 110 of the outer jacket 106 and the second surface 208 extends at an offset distance 'D' (shown in FIG. 2D) from the first surface 206. The second surface 208 of the ring body 130 and the outer surface 110 of the outer jacket 106 are together configured to define a gap 'G' (shown in FIG. 3) therebetween to receive water leaking from outside the outer jacket 106. Particularly, a thickness of the second surface 208 is less than a thickness of the first surface 206 to define the offset distance 'D'.

The ring body 130 further includes a valley 210 defined in the first surface 206. The valley 210 is shaped and positioned in such a way that it redirects the leaking water collected in the gap 'G' towards the protrusion 122. In a non-limiting example, as shown in FIG. 2A, the valley 210 has a parabolic shape. In some embodiments, the valley 210 may be contemplated to have a geometric shape such as, for example, a rectangle, a square, an elliptical, a triangle, or a semicircle. The ring body 130 further includes an upper edge 212 and a lower edge 214 defining a height 'H' thereof. In one embodiment, the upper and lower edges 212, 214 of the ring body 130 may have a flat or curved surface. In another embodiment, each of the upper and lower edges 212, 214 of the ring body 130 may have a chamfered surface. As shown in FIG. 2B, the ring body 130 further includes a through hole 216 defined in the first surface 206 coaxial to the protrusion 122. In an embodiment, the through hole 216 may have a rectangular shape. In some embodiments, the through hole 216 may have a square, a circular, an oval, an elliptical, a triangle, or any other geometrical shape known in the art.

In one embodiment, a portion defining the first surface 206 and a portion defining the second surface 208 of the ring body 130 may have a solid body construction. Further, the ring body 130 may be made of materials such as, for example, polymers, metals, fiberglass, rubber, plastic, or any other materials known in the art. In a non-limiting example, the ring body 130 may be made from a molding process, a die casting process, or an extrusion process. In another embodiment, the portions defining the first surface 206 and the second surface 208 of the ring body 130 may be made from multiple pieces. In such a case, the portions defining the first surface 206 and the second surface 208 may be mechanically attached to one another. Further, the portions of the first surface 206 and the second surface 208 may be coupled using one or more coupling methods including, but not limited to, adhesion, welding, or soldering. In yet another embodiment, the portions defining the first surface 206 and the second surface 208 may have a modular body construction i.e., the portions of the first surface 206 and the second surface 208 may be detachably attached to each other. In such a case, the portions defining the first surface 206 and the second surface 208 may be coupled using one or more detachable coupling methods including, but not limited to, fastening devices, snap-fittings, or press-fittings. Further, the portion defining the first surface 206 may include the protrusion 122, the lower edge 214, and one or more notches. The portion defining the second surface 208 may include the upper edge 212 and one or more notches, such that when the portions defining the first surface 206 and the second surface 208 are attached with one another using the notches, the ring body 130 may be formed with the through hole 216.

The ring body 130 includes the protrusion 122 that extends from the inner surface 124 thereof. In particular, the protrusion 122 extends from the first surface 206 of the inner surface 124 of the ring body 130. More particularly, the protrusion 122 extends from the first surface 206 along the radial axis 'R' of the water heater 100 and into the insulation space 108 defined between the tank 104 and the outer jacket 106. The protrusion 122 is configured to receive water passing through the insulation space 108 of the water heater 100 and the gap 'G' defined between the outer jacket 106 and the ring body 130.

Referring to FIG. 1B and FIG. 2A, in one embodiment, the leak detection apparatus 102 includes four ring bodies 130 which together define the circular band 120 around the outer jacket 106. Each ring body 130 includes at least one protrusion 122 as such the circular band 120 includes four protrusions 122. Each protrusion 122 of the ring body 130 is coaxially aligned with the corresponding through hole 216 defined on the outer surface 126 of the ring body 130.

Figure 2C:
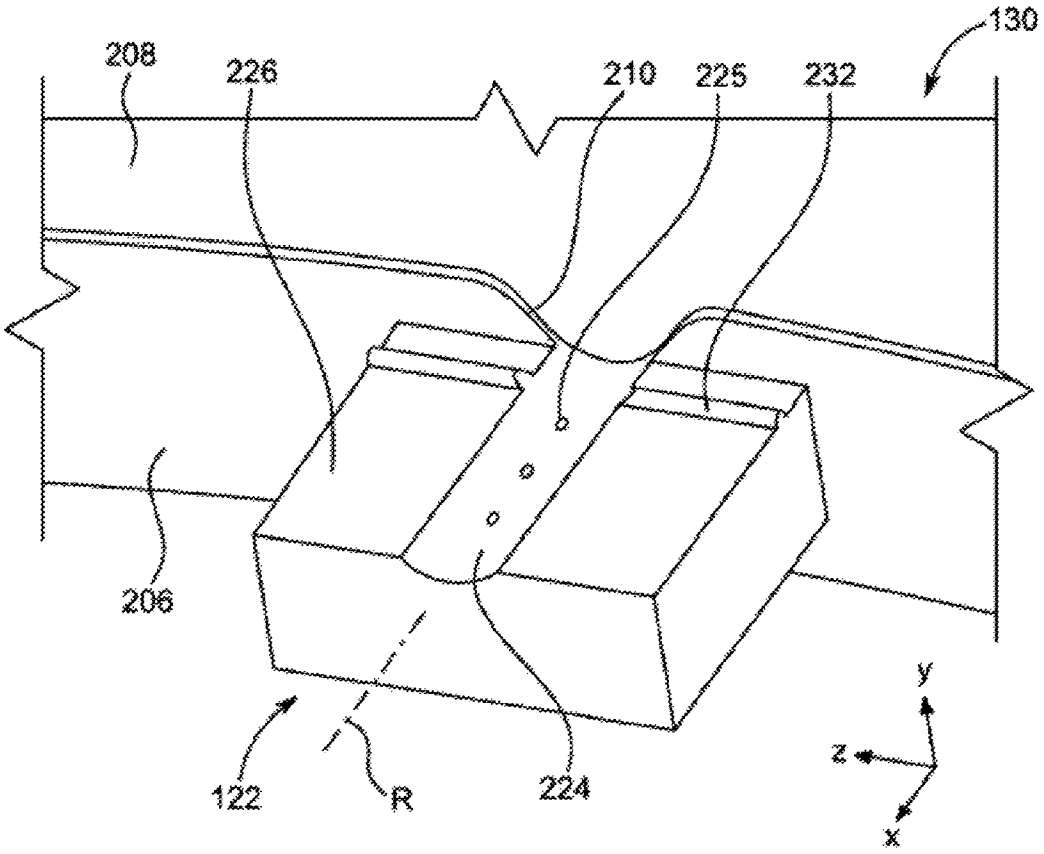
FIG. 2C is an enlarged perspective view of a protrusion of the ring body of FIG. 2A.

Referring to FIG. 2C, an enlarged perspective view of the protrusion 122 of the ring body 130 is illustrated, according to an embodiment of the present disclosure. The protrusion 122 has a length 'L' less than a radial length 'RL' of the insulation space 108. In some embodiments, the protrusion 122 may have the length 'L' substantially equal to the radial length 'RL' of the insulation space 108. Further, the protrusion 122 may be positioned at a center of the arcuate length of the ring body 130. In an embodiment, the protrusion 122 has a cuboidal shape. In some embodiments, the protrusion 122 is contemplated to have a geometric shape such as, for example, cubical, conical, cylindrical, hemi-spherical, pyramidal, rounded conical, and frustum The dimensions of the protrusion 122 are defined in such a way that it effectively enables the protrusion 122 to collect and redirect the water passing through the insulation space 108 and the gap 'G' of the water heater 100. As shown in FIG. 2C, the x-axis in a three-dimensional (3D) coordinate system denotes a direction in which the protrusion 122 extends, therefore the x-axis is alternatively referred to as the radial axis 'R' of the water heater 100.

Figure 2D:
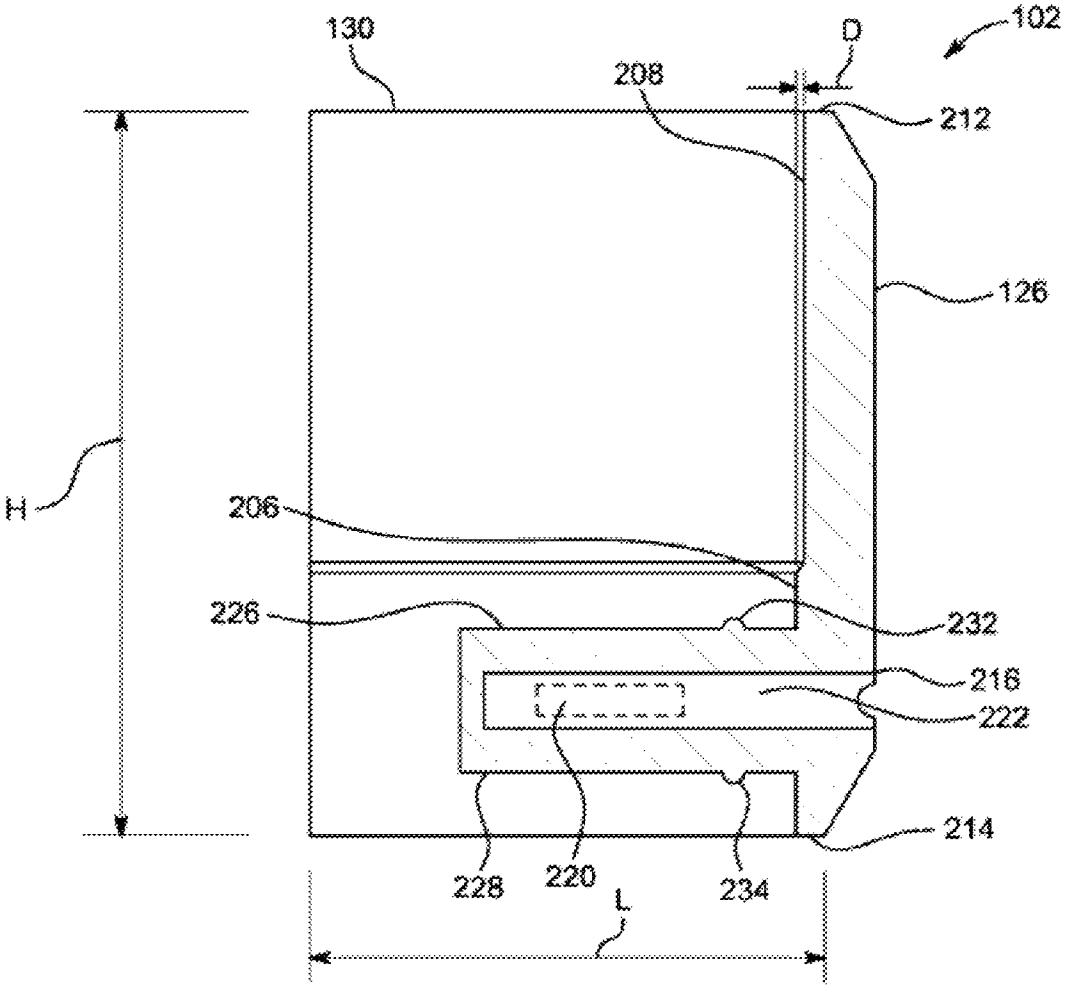
FIG. 2D is a cross-sectional view of the protrusion of the ring body.

Referring to FIG. 2D, a cross-sectional view of the ring body 130 showing the protrusion 122 is illustrated, according to an embodiment of the present disclosure. As shown in FIG. 2C and FIG. 2D, the leak detection apparatus 102 further includes a sensor 220 disposed in the protrusion 122. The sensor 220 is configured to generate a signal indicative of water present in the protrusion 122. In an embodiment, the protrusion 122 is a hollow body having a cavity 222 and configured to accommodate the sensor 220 therein. In an embodiment, a length of the cavity 222 may be less than the length 'L' of the protrusion 122 in the x-direction. Further, a height of the cavity 222 may be less than a height of the protrusion 122 in the y-direction. In some embodiments, the cavity 222 may have a geometric shape such as, for example, a square, a rectangle, a circle, an oval, and an elliptical such that any type of the sensor 220 may be housed therein. Further, the through hole 216 of the ring body 130 is configured to communicate with the cavity 222 of the protrusion 122 and accommodate wiring of the sensor 220.

The protrusion 122 further includes an elongated groove 224 defined along the radial axis 'R'. Particularly, the elongated groove 224 is defined on a top surface 226 of the protrusion 122. In an embodiment, the elongated groove 224 has a semicircular cross-section. In some embodiments, the elongated groove 224 may have a rectangle, a square, an elliptical, an oval, or any other polygon shape known in the art. Particularly, the elongated groove 224 is contemplated to have a desired geometric shape such that the protrusion 122 is able to collect and redirect water passing through the insulation space 108 and the gap 'G' of the water heater 100. In an embodiment, the elongated groove 224 traverses along the entire length 'L' of the protrusion 122 in the x-direction. In some embodiments, a length of the elongated groove 224 may be less than the length 'L' of the protrusion 122. Furthermore, the elongated groove 224 is contemplated to have a desired width in z-direction and a desired depth in y-direction so as to enable and ensure effective working of the leak detection apparatus 102. In some embodiments, the elongated groove 224 may include a slope such that entire water passing through the insulation space 108 is easily transported by the effect of gravity to allow the sensor 220 to generate signal indicative of the water leakage in the water heater 100.

In some embodiments, the shape and dimensions of the elongated groove 224 may also affect shape and dimensions of the valley 210. As described above, the valley 210 is shaped and positioned in such a way that it redirects the leaking water collected in the gap 'G' towards the protrusion 122. To be more particular, the valley 210 is shaped and positioned in such a way that it redirects the leaking water collected in the gap 'G' towards the elongated groove 224 of the protrusion 122. In some embodiments, it is contemplated that the shape and dimensions of the elongated groove 224 may not affect the shape and dimensions of the valley 210. In one example, the elongated groove 224 may have a circular cross-section and the valley 210 may have a rectangular cross-section, wherein a width of the elongated groove 224 may be narrower or wider than that of the valley 210. However, even in such cases, the valley 210 may still be able to redirects the leaking water collected in the gap 'G' towards the elongated groove 224.

In some embodiments, the elongated groove 224 can include one or more holes 225 (as shown in FIG. 2C) to transport the moisture/water collected in the elongated groove 224 into the cavity 222. The cavity 222 accommodates the sensor 220 capable of detecting moisture/water and generate the signal indicative of water leak. In some embodiments, the one or more holes 225 may accommodate wicking material capable of wicking and transporting the collected moisture/water to the cavity 222. It is contemplated that the one or more holes 225 may be located anywhere on the elongated groove 224 depending upon the design and requirements of the water heater 100. Furthermore, the one or more holes 225 may be of any size and shape, for example, circle, elliptical, oval, rectangle, square, or triangle. It may be understood that the location, size, and shape of the one or more holes 225 may be defined in such a way that the one or more holes 225 can effectively transport collected moisture/water to the cavity 222, accommodate the wicking material therein, and prevent excessive pooling of water in the elongated groove 224.

As shown in FIG. 2C and FIG. 2D, in certain embodiments, the protrusion 122 includes an upper transverse ridge 232 and a lower transverse ridge 234. The upper transverse ridge 232 is provided on the top surface 226 of the protrusion 122 and the lower transverse ridge 234 is provided on a bottom surface 228 of the protrusion 122. The upper and lower transverse ridges 232, 234 extend in the z-direction perpendicular to the elongated groove 224. The upper and lower transverse ridges 232, 234 are configured to allow the protrusion 122 to lock and connect with the outer jacket 106 of the water heater 100 when inserted through the opening 302 provided in the outer jacket 106. The upper and lower transverse ridges 232, 234 are contemplated to have desired shape and dimensions to allow a snug-fit between the ring body 130 and the outer jacket 106 of the water heater 100. In an embodiment, each of the upper and the lower transverse ridges 232,234 may have a semicircular cross-section. In some embodiments, the upper and lower transverse ridges 232, 234 may have a cross-sectional shape such as, for example, a rectangle, a square, a triangle, or semi elliptical. In one embodiment, the upper transverse ridge 232 and the lower transverse ridge 234 may have identical shapes and dimensions. In another embodiment, the upper transverse ridge 232 and the lower transverse ridge 234 may have dissimilar shapes and dimensions. In some embodiments, the upper and lower transverse ridges 232, 234 are defined on the protrusion 122 at a distance from the first surface 206 of the ring body 130 based on a thickness of a wall of the outer jacket 106. The protrusion 122 extends towards the tank 104 from the first surface 206 of the ring body 130 at a distance defined between the bottom surface 228 of the protrusion 122 and the lower edge 214 of the ring body 130. In an embodiment, the protrusion 122 may be placed at center of a height of the first surface 206 in the y-direction. In another embodiment, the protrusion 122 may extend from a top edge of the first surface 206 such that the top edge of the first surface 206 and the top surface 226 of the protrusion 122 may be co-planar.

Further, the first surface 206 and the second surface 208 are offset to one another by the offset distance 'D'. The offset distance 'D' may be defined based on the design and requirements of the water heater 100. In an embodiment, the offset distance 'D' is designed such that the second surface 208 of the ring body 130 and the outer surface 110 of the outer jacket 106 together define the gap 'G' therebetween to receive water leaking from outside the outer jacket 106.

Figure 3:
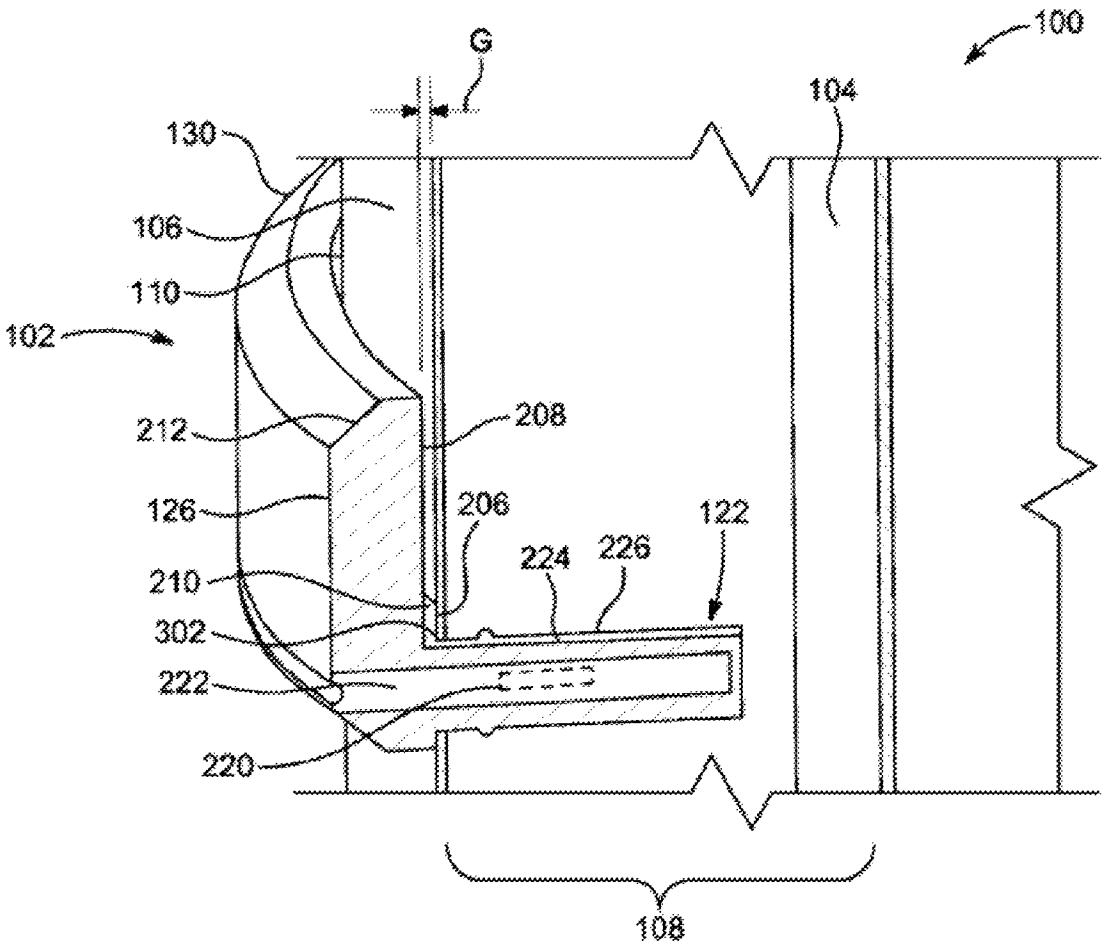
FIG. 3 is a cross-sectional view of a portion of the water heater showing the leak detection apparatus.

Referring to FIG. 3, a cross-sectional view of a portion of the water heater 100 showing the leak detection apparatus 102 is illustrated, according to an embodiment of the present disclosure. The protrusion 122 protrudes into the insulation space 108 through the opening 302 and collects the water passing through the insulation space 108. In a non-limiting example, the opening 302 of the outer jacket 106 may have a cross-sectional shape identical to a cross-sectional shape of the protrusion 122. The water leaking from the tank 104 is collected in the elongated groove 224 of the protrusion 122. Also, water leaking from the outer jacket 106 is received through the gap 'G' defined between the second surface 208 of the ring body 130 and the outer surface 110 of the outer jacket 106. The water leaking through the gap 'G' is further collected in the elongated groove 224 via the valley 210. The presence of water in the protrusion 122 is detected by the sensor 220 disposed in the cavity 222 of the protrusion 122. Upon detecting the water, the sensor 220 generates the signal indicative of the water leak. In an embodiment, the signal generated by the sensor 220 may be communicated with a control unit (not shown) of the water heater 100. The control unit may further stop operation of the water heater 100 based on the signal received from the sensor 220 or may provide a warning to a user or an operator of the water heater 100. Thus, water leaking through the gap 'G', the insulation space 108, or both may be detected by the sensor 220. In one embodiment, the signal generated by the sensor 220 may be communicated with a visual indicator to provide warning in the form of, for example, a solid warning light or a blinking warning light. In another embodiment, the signal may be communicated with an audio indicator to provide warning in the form of, for example, a beep sound. In another embodiment, the signal may be communicated with an audio-visual indicator to provide warning in the form of, for example, a blinking light accompanied by a beep sound. In other embodiments, the sensor is in communication with a suitable communication module configured to communicate the signal, such as via a wireless connection, to a user interface device, such via a mobile application on a smart phone or smart home device.

Figure 4:
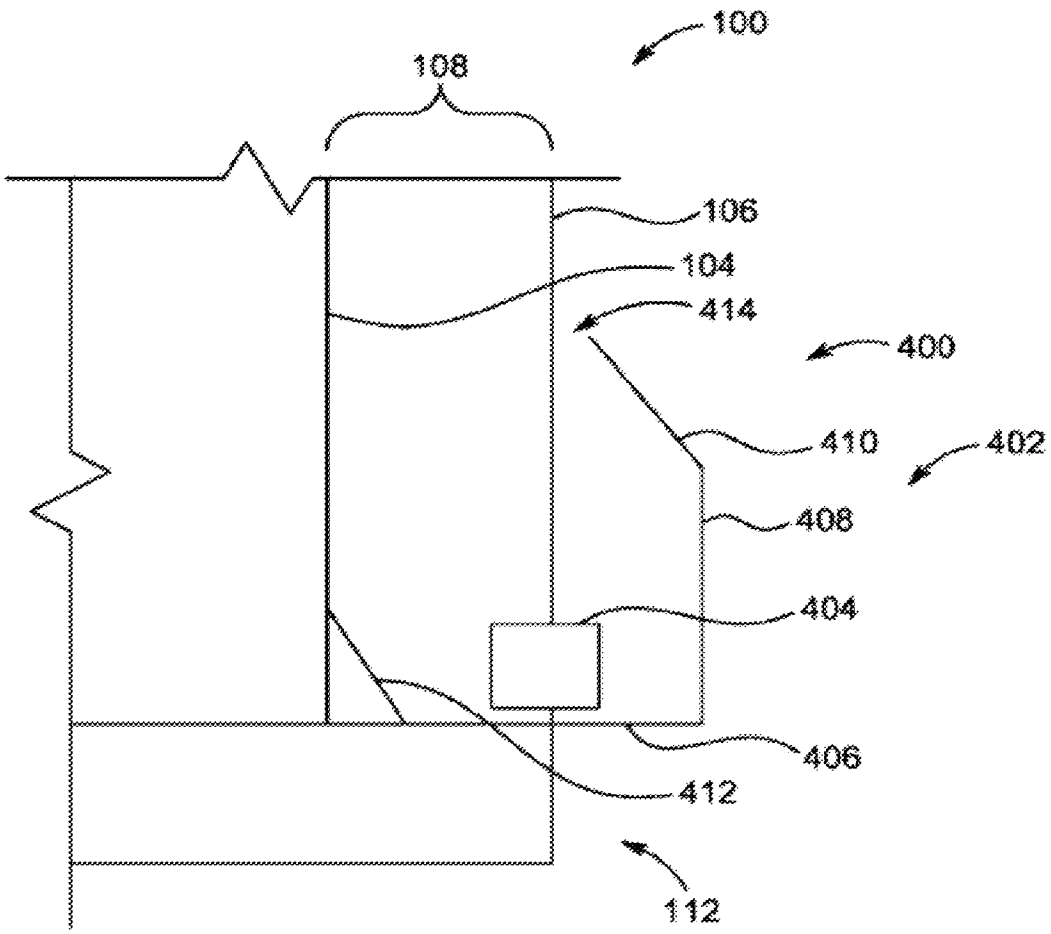
FIG. 4 is a schematic block diagram showing leak detection apparatus coupled to the water heater.

Referring to FIG. 4, a schematic block diagram showing a leak detection apparatus 400 coupled to the water heater 100 is illustrated, according to an embodiment of the present disclosure. The leak detection apparatus 400 is disposed around the water heater 100. Particularly, the leak detection apparatus 400 is disposed around the outer surface 110 of the outer jacket 106 of the water heater 100. In an embodiment, the leak detection apparatus 400 may be located proximate the bottom end 112 of the water heater 100. Particularly, the leak detection apparatus 400 may be located on a bottom pan of the water heater 100. The leak detection apparatus 400 is capable of collecting water passing through the insulation space 108 and water leaking from outside the outer jacket 106.

The leak detection apparatus 400 includes an annular container 402 disposed around the outer surface 110 of the outer jacket 106 and a sensor 404 disposed at bottom of the annular container 402. The annular container 402 includes a floor 406, a wall 408 extending vertically from the floor 406 and a slanting wall 410 extending from the wall 408. The annular container 402 may be made of materials such as, for example, polymers, metals, fiberglass, rubber, and plastic. As shown in FIG. 4, a sloped wall 412 is disposed inside the insulation space 108. In an embodiment, the sloped wall 412 is defined between the tank 104 and the floor 406 of the annular container 402. The sloped wall 412 transports the water passing through the insulation space 108 towards the sensor 404.

A portion of the floor 406 of the annular container 402 at least partially traverses into the insulation space 108 in a radial direction and remaining portion is disposed outside the outer jacket 106. In an embodiment, the sensor 404 is located on the floor 406 of the annular container 402. In some embodiments, the annular container 402 may include a plurality of sensors 404. In yet another embodiment, the annular container 402 may include a wicking material extending around a perimeter thereof such that the water collected anywhere in the annular container 402 is transported by the wicking material to the sensor 404.

The annular container 402 is disposed around the outer jacket 106 in such a manner that a passage 414 is defined between the slanting wall 410 and the outer jacket 106. The passage 414 defined between the outer jacket 106 and the annular container 402 allows water leaking from outside the outer jacket 106 to travel into the annular container 402. As described above, the sensor 404 is capable of generating a signal indicative of the water received within the annular container 402 and collected at bottom of the insulation space 108.

The present disclosure relates to the leak detection apparatus 102 having the circular band 120 formed by the plurality of ring bodies 130. The circular band 120 is disposed proximate the bottom end 112 of the water heater to effectively collect the water leaking from the tanks 104 and the outer jacket 106. The circular band 120 formed by the multiple ring bodies 130 facilitate easy maintenance and assembly of the leak detection apparatus 102 on the water heater 100. The gap 'G' provided between the second surface 208 of the circular band 120 and the outer surface 110 of the outer jacket facilitates easy and effective collection of water leaking from the outer jacket 106. Further, the first surface 206 of the circular band 120 fluid tightly engages with the outer surface 110 of the outer jacket 106 to prevent leaking of water therethrough. The protrusions 122 having the elongated groove 224 facilitate effective collection of water leaking from the tank 104 and the outer jacket 106. As such, the water leaking from the tank 104 and the outer jacket 106 may be entirely collected at the protrusions 122 to effectively detect the leakage using the sensors 220. Accumulation of water leaked from the tank 104 and the outer jacket 106 at the protrusions 122 improves the responsiveness of leak detection apparatus 102. Having the sensor 220 disposed within the cavity 222 of the protrusion 122 and accessing the cavity 222 via the through hole 216 allow easy maintenance and servicing of the sensor 220. Further, wire routing to the sensor 220 is also made easier with the help of the through hole 216 defined in the circular band 120.

Figure 5:
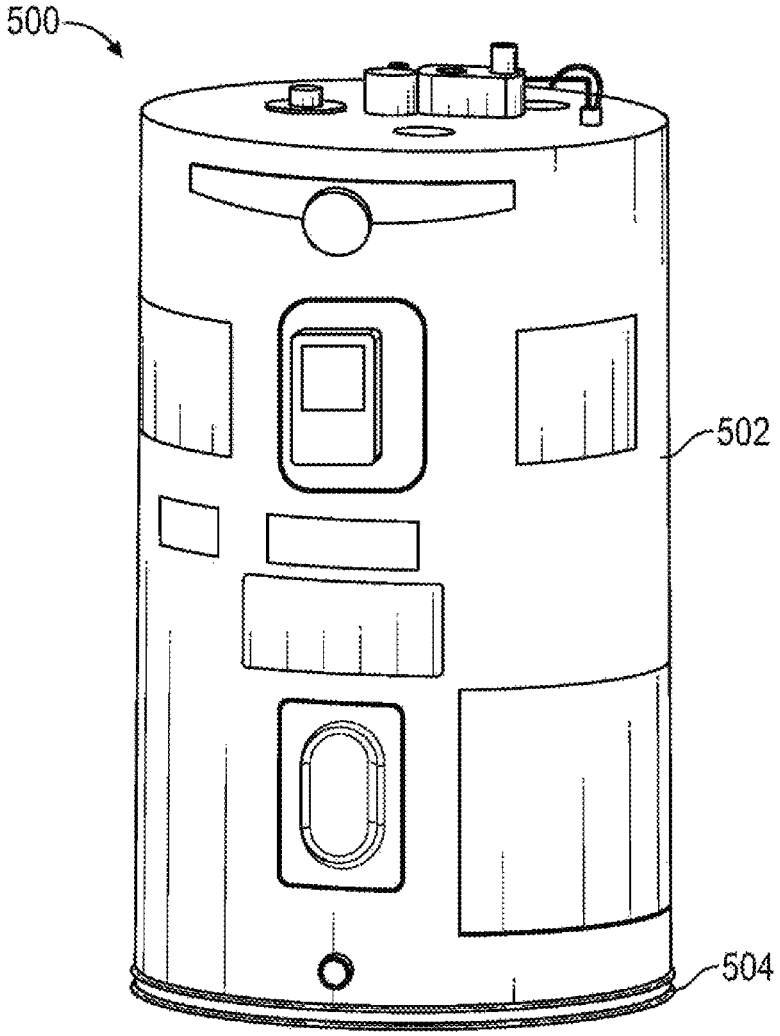
FIG. 5 is an example water heater, in accordance with the disclosed technology.

Turning to FIG. 5, an example water heater 500 can include an outer jacket 502 and a storage tank located within the outer jacket 502. The storage tank can be configured to store water, such as water to be heated by the water heater 500. The water heater 500 can include a bottom pan 504 that interfaces with (e.g., at least partially receives) and/or supports the storage tank and the outer jacket 502. Furthermore, the water heater 500 can include a leak detection system that is configured to detect water (or any appropriate fluid) that leaks from the water heater 500 (e.g., from the storage tank). One of ordinary skill in the art can understand and appreciate that in addition to the components described above, the water heater 500 can include many other additional components such as, thermostats, heating elements, dip tubes, plumbing, drain pipes, etc. However, said additional components are not described herein to avoid obscuring the features of the disclosed leak detection system.

As discussed herein, it can generally be cost-prohibitive for water heaters to include sensors along the circumference of the water heater. However, a cost-effective design for a leak detection system configured to detect a water leak along the circumference of a water heater is disclosed in U.S. application Ser. No. 15/815,305, entitled "Integrated leak detection system for water heaters" and now issued as U.S. Pat. No. 10,753,647, the entire contents and substance of which is incorporated as if fully set forth herein. As a specific example, U.S. application Ser. No. 15/815,305 discloses a leak detection system including a sensor assembly that includes a wicking tube formed of a wicking material. The wicking material is disposed at least partially around a leak sensor and extends around at least a portion of the circumference of the water heater. The wicking material is configured to transport water toward the leak sensor.

The disclosed technology improves upon the concepts and designs disclosed in U.S. application Ser. No. 15/815,305. For example, the disclosed technology improves the speed and ease with which the leak detection system can be installed, which can decrease manufacturing costs.

As illustrated in FIGS. 6-8C, the disclosed technology includes a leak detection system 600 that includes a wicking material 610 (e.g., a fluid removing portion). The wicking material 610 can be configured to extend along some or all of the circumference of a water heater 500. Thus, if the wicking material 610 extends along all of the circumference of the water heater 500, the wicking material 610 can form a ring. The cross-sectional shape of the wicking material 610 can be substantially flat. The outer and inner surfaces of the wicking material 610 can be substantially parallel when the wicking material is in an uncompressed state. The outer surface can, in some configurations, contact or abut an inner surface of the bottom pan 504 and/or a surface (e.g., inner, outer) of the jacket 502. The wicking material 610 can comprise fibers or strands of material that are arranged to provide capillary action. For example, the wicking material can comprise woven fibers. The wicking material can comprise any useful material capable of providing capillary action.

Figure 6:
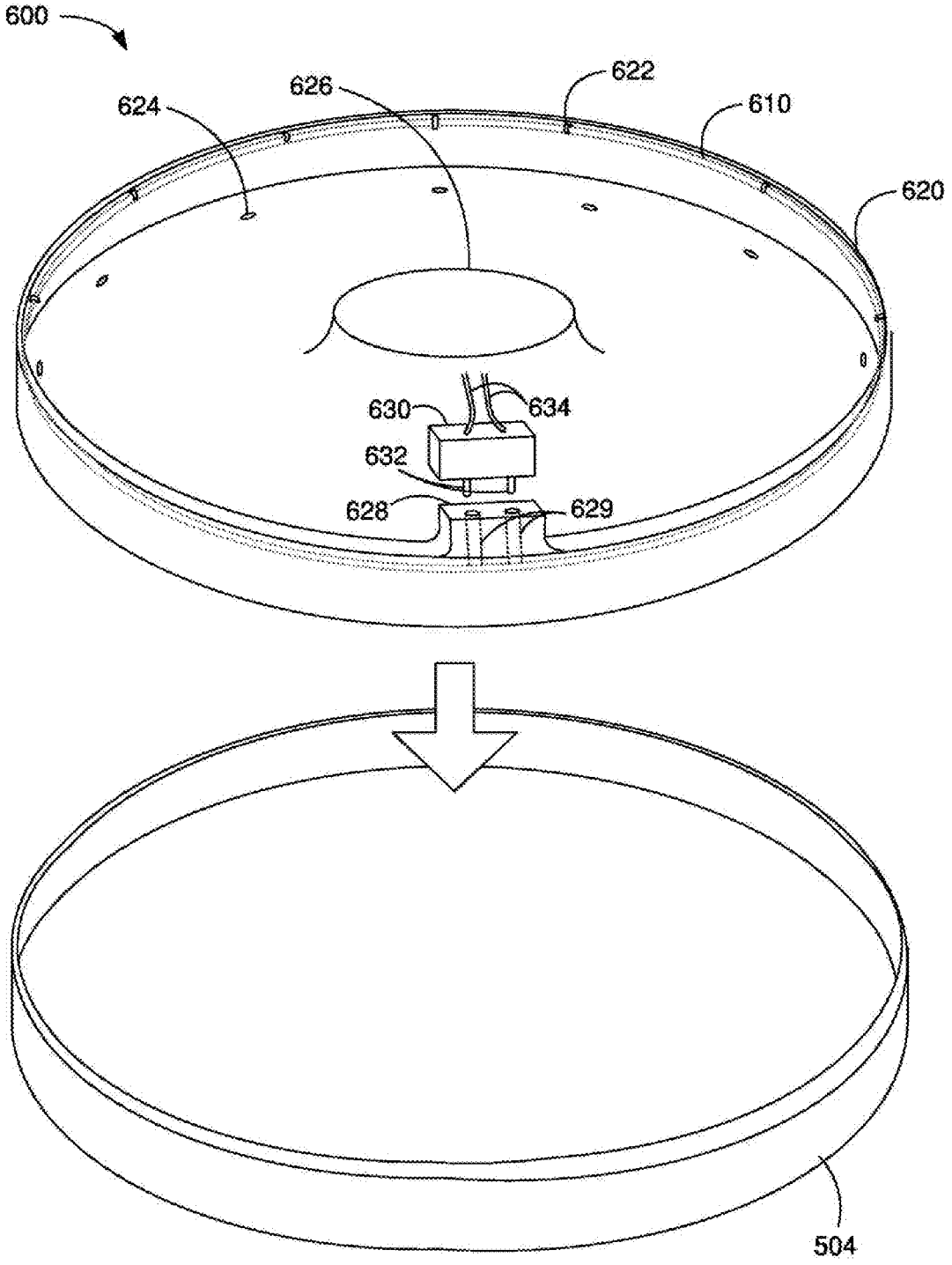
FIG. 6 is an exploded view of an example leak detection system including a rigid structure, in accordance with the disclosed technology.

Referring now to FIG. 6, the leak detection system 600 can include a rigid structure 620 that can be configured to be inserted into the bottom pan 504. As illustrated, the rigid structure 620 can have a general shape and configuration that similar to (or substantially the same as) the bottom pan 504. The outer wall of the rigid structure 620 can have a diameter that is approximately the same or less than the inner wall of the bottom pan 504. As such, the rigid structure 620 can be configured to at least partially insert into the bottom pan 504. Further, the rigid structure 620 can be configured to collect and retain any leaked water before it contacts the bottom pan 504 and/or to prevent water from collecting between the outer wall of the rigid structure 620 and the outer wall of the bottom pan 504.

As illustrated, the wicking material 610 can be disposed along the circumference of the rigid structure 620. The wicking material 610 in FIG. 6 is shown as being located at or near the top edge of the rigid structure 620, but the disclosed technology is not so limited. Indeed, the wicking material 610 can be located at any desired height (relative a bottom of the rigid structure 620), and the height can correspond to a predetermined volume of water at which it is desirable to alert that a leak has occurred. The wicking material 610 can be retained by one or more attachment structures 622, which can be or includes clasps, hooks, or the like. Alternatively or in addition, the wicking material 610 can be attached to the rigid structure 620 via an adhesive, double-sided tape, or the like. Alternatively or in addition, the sidewall of the rigid structure 620 can include a recess that is configured to at least partially receive the wicking material 610. For example, the recess can form a step or ledge on which the wicking material 610 can rest.

The rigid structure 620 can include apertures 624 on the bottom surface of the rigid structure 620, and the apertures 624 which can permit any water that has collected in the bottom pan 504 (and outside of the rigid structure 620) to enter the rigid structure 620. The bottom surface of the rigid structure 620 can have a gradient or slope bias downward in the radially outward direction such that the bottom surface can guide any leaked water toward the outer perimeter of the rigid structure where the wicking material 610 is located. For example, the bottom surface of the rigid structure 620 can include a protrusion or mound 626 at or near the center of the rigid structure 620. The mound 626 can have a flat top as illustrated. Alternatively, the mound 626 can be substantially domed and/or semispherical.

The rigid structure 620 can include a port 628 configured to at least partially receive a plug 630 of a leak sensor. The port 628 can be molded into the body of the rigid structure 620 such that rigid structure 620 is a unitary piece. The plug 630 can include one or more prongs 632, which can be configured to extend or insert into one or more corresponding receptacles 629 of the port 628. The prongs 632 can be configured to contact and/or insert into the wicking material 610 via the receptacles 629. As such, the leak sensor can be configured to detect the presence of water in the wicking material 610. The plug 630 can include one or more wires which can extend from the plug to logic circuitry, a controller, or the like.

Figure 7A:
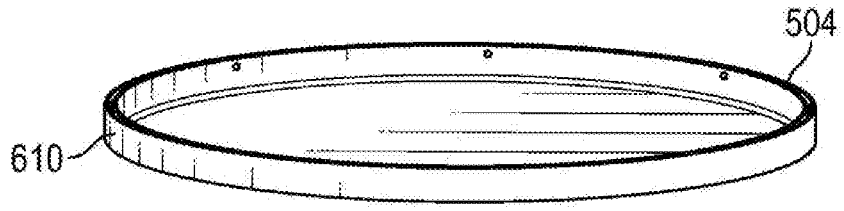
FIG. 7A is a perspective view of a wicking material of an example leak detection system installed on a bottom pan, in accordance with the disclosed technology.
Figure 7B:
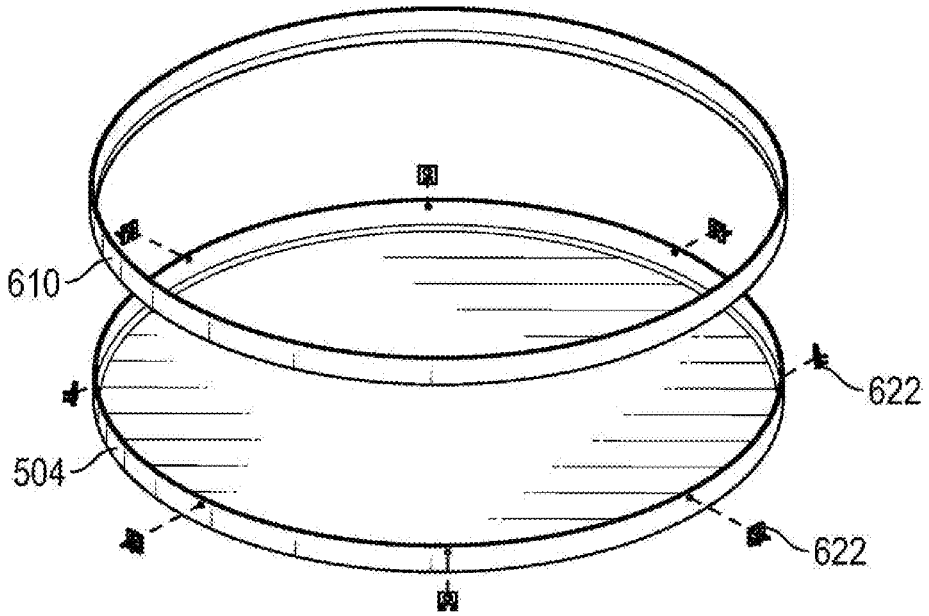
FIG. 7B is an exploded view of an example leak detection system installed on a bottom pan, in accordance with the disclosed technology.
Figure 7C:
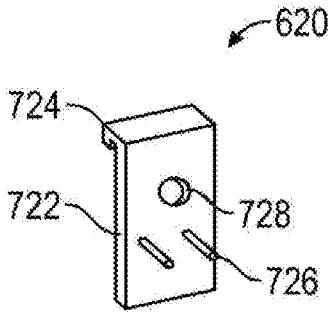
FIG. 7C is a perspective view of an example attachment structure, in accordance with the disclosed technology.

Referring now to FIGS. 7A-7C, the leak detection system 600 can omit the rigid structure 620. As such, the wicking material 610 can be attached to the bottom pan 504. The wicking material 610 can be attached to the bottom pan 504 by one or more attachment structures 622, which can be or includes clasps, hooks, or the like. Alternatively or in addition, the wicking material 610 can be attached to the rigid structure 620 via an adhesive, double-sided tape, or the like.

As shown most clearly in FIG. 7C, the attachment structure 622 can include a body 722 and an overhang feature 724 that is configured to overlap the top edge of the sidewall of the bottom pan 504. The attachment structure 622 can include one or more prongs 726 configured to insert into and/or retain the wicking material 610. Although not shown, the prongs 726 can include a barb, hook, or other retaining structure. The overhang feature 724 can be configured to position the attachment structure 622 at a desired location along the circumference of the bottom pan 504. For example, the overhang feature 724 can enable a user to quickly and easily position the attachment structure 622 such that a hole 728 of the attachment structure 622 aligns with a hole of the bottom pan that will ultimately accept a screw for connecting the bottom pan 504 to the jacket 502. As illustrated, the body 722 of the attachment structure 622 can be positioned along the outer surface of the bottom pan's 504 sidewall. Alternatively, the body 722 of the attachment structure 622 can be positioned along the inner surface of the bottom pan's 504 sidewall. In either instance, and particularly if the body 722 of the attachment structure 622 is positioned along the outer surface of the bottom pan's 504 sidewall, attachment structures 622 can be positioned along the circumference of the bottom pan, and a screw can be driven at each location, sequentially extending radially inward through the attachment structure 622, the sidewall of the bottom pan 504, and the jacket 502. Thus, if the body 722 of the attachment structure 622 is positioned along the outer surface of the bottom pan's 504 sidewall, the wicking material 610 can be attached to the attachment structure 622 without a screw extending through the wicking material 610, which can avoid decreasing the capillary action of the wicking material 610 with insert of the screw therethrough. Although not shown in FIGS. 7A-7C, one or more prongs, wires, or the like can extend into wicking material 610 and electrically connect the wicking material 610 to the leak sensor and/or a controller.

Figure 8A:
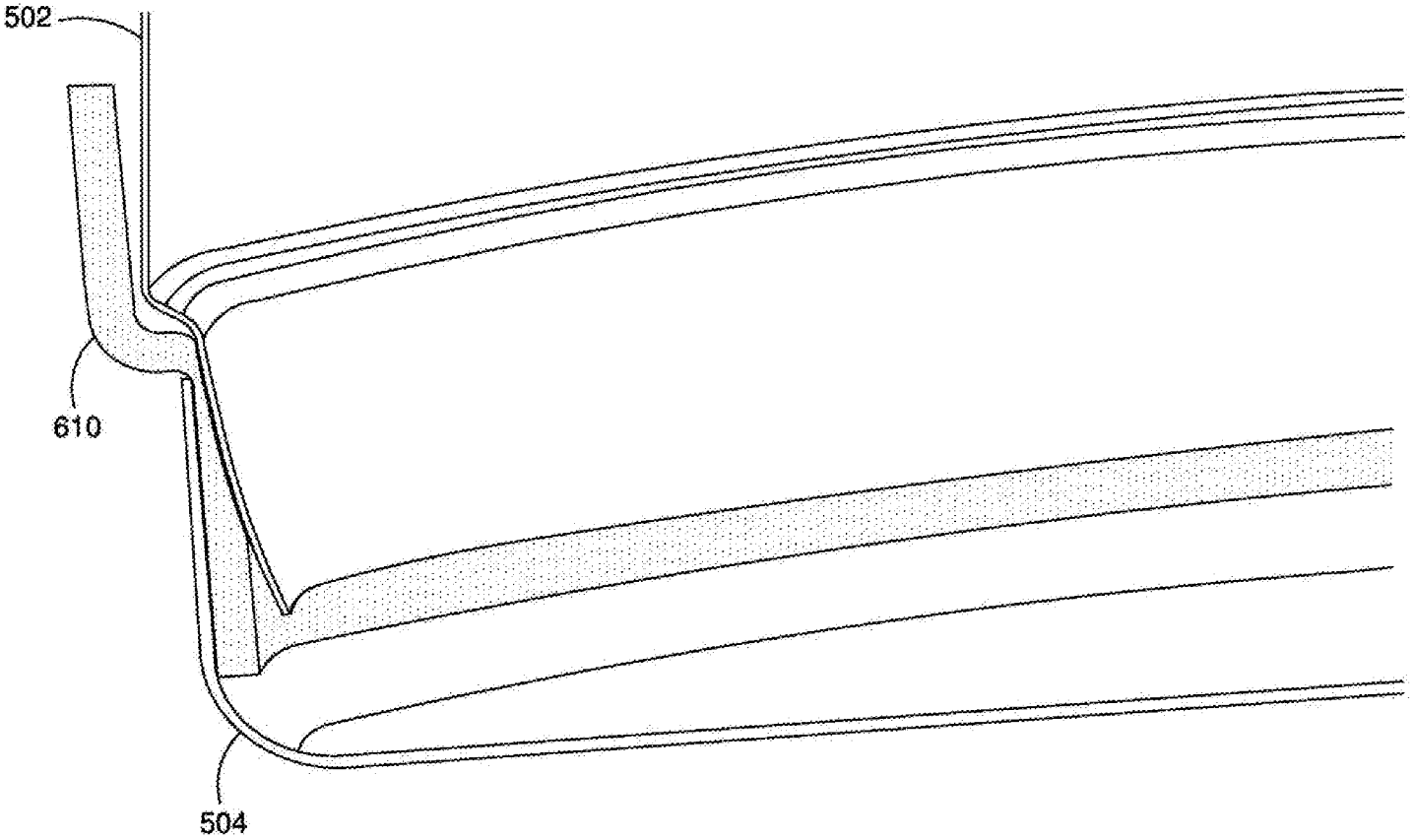
FIG. 8A is an enlarged sectional view of a wicking material of an example leak detection system in which the wicking material is installed at both interior and exterior locations of a water heater, in accordance with the disclosed technology.
Figure 8B:
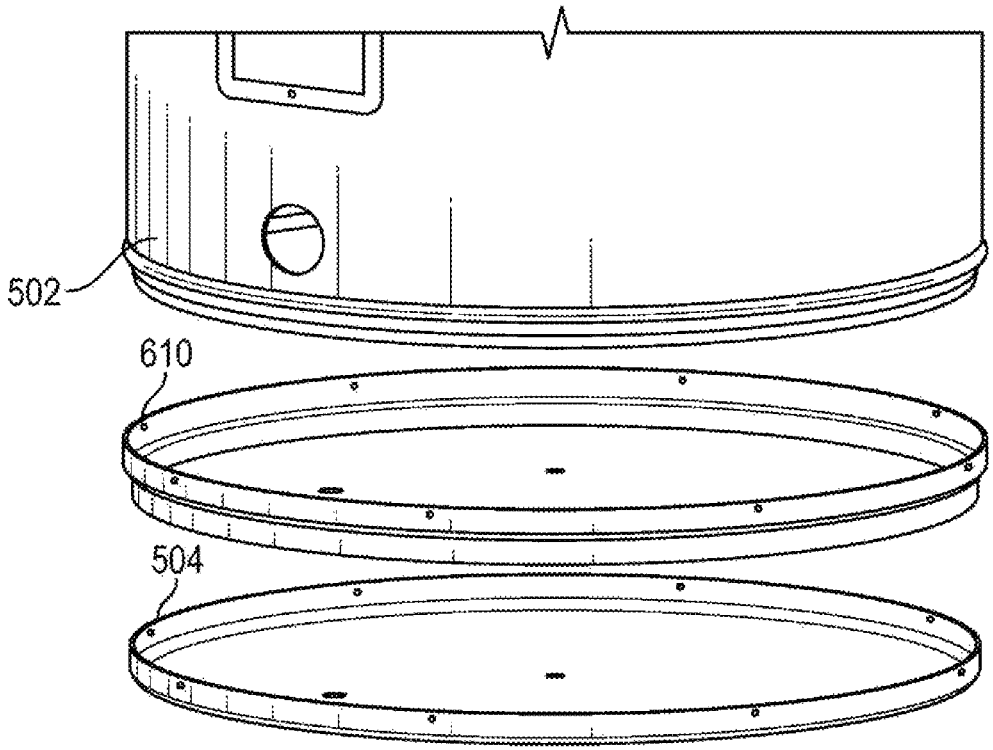
FIG. 8B is an exploded view of the configuration shown in FIG. 8A, in accordance with the disclosed technology.
Figure 8C:
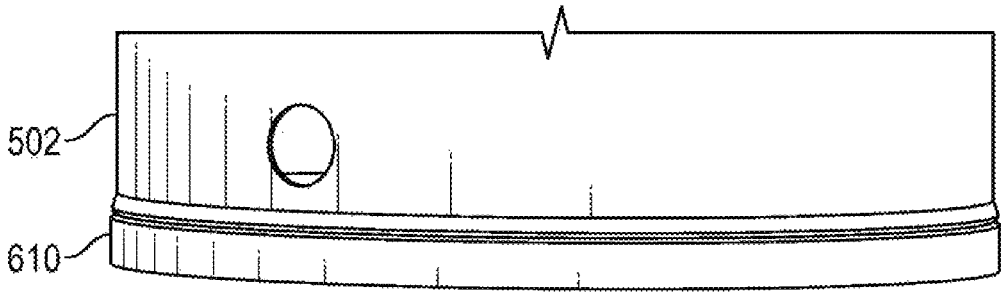
FIG. 8C is a perspective view of the configuration shown in FIG. 8A with the bottom pan omitted, in accordance with the disclosed technology.

As illustrated in FIGS. 8A-8C, the wicking material 610 can include a first portion configured to extend into the bottom pan 504 (e.g., along an inner surface of the sidewall of the bottom pan 504) and a second portion configured to extend along a portion of the outer surface of the jacket 502. Alternatively or in addition, the wicking material 610 can have a height that is greater than a height of the sidewall of the bottom pan 504. Referring to FIG. 8A in particular, the wicking material 610 can be pinched between the inner surface of the sidewall of the bottom pan 504 and the outer surface of the jacket 502 (e.g., at or near the jacket 502). Thus, when installed, the wicking material 610 can be located both inside and outside the water heater 500. As such, there is flexibility as to where the leak sensor can be located. That is to say, because the wicking material 610 is located both within and outside the water heater 500, the leak sensor can likewise be located, and/or in direct communication with the wicking material 610, at a location that is within the water heater 500 (e.g., in or on the bottom pan 504) or outside the water heater 500 (e.g., in a housing on an exterior surface of the jacket 502).

When the wicking material 610 is located both inside and outside the water heater 500, the leak detection system 600 can be configured to detect the presence of water or another fluid in either location. For example, the leak detection system 600 can be configured to detect water in the bottom pan 504, and/or the leak detection system 600 can be configured to detect water on the outside of the water heater 500, which could be attributed to pipe leaks, bad braising at pipe connections, or the like, as non-limiting examples. Further, when the wicking material 610 extends to the exterior of the water heater 500, there is provided visual affirmation of the presence of a leak detection system for customers and potential customers.

The wicking material 610 can be substantially flat (as described herein) when in an uncompressed and/or uninstalled state. While the exploded view of FIG. 8B shows the wicking material as being contoured, it should be appreciated that such contour would typically occur upon installation and assembly of the bottom pan 504, wicking material 610, and jacket 502.

The wicking material 610 can be wrapped around and/or attached to the bottom pan 504 and/or jacket 502 (e.g., via an attachment structure 622 and/or adhesive) prior to attaching the jacket 502 to the bottom pan 504, which can increase the ease and speed of assembly, as compared to existing leak detection systems.

In the various configurations discussed herein, the wicking material 610 has been described and illustrated primarily as extending along the entirety of the circumference of the water heater 500 (e.g., bottom pan 504). The disclosed technology is not so limited. Instead, one or more pieces or sections of wicking material 610 can be located and/or extend along a particular section of the water heater 500 (e.g., bottom pan 504), such as a particular section of the circumference of the water heater 500 (e.g., bottom pan 504). Further, the wicking material 610 can be manufactured to form a ring. Alternatively or in addition, the wicking material 610 can comprise a strip of material. The strip of wicking material 610 can have ends that can be butted together or the ends can be overlapped.

Further, the leak detection system 600 has heretofore been described as including a wicking material 610 located at a certain height relative the base portion of the bottom pan 504. However, the disclosed technology is not so limited. For example, the leak detection system 600 can include a first wicking material 610 located at a first height and a second material located at a second height that is greater than the first height. The leak detection system 600 can likewise include three, four, or more wicking materials 610 at different heights. The leak detection system 600 can be configured to output an alert (e.g., via a display of the water heater 500, to a computing device associated with the user) indicating the particular wicking material 610 that has detected water. For example the first, lower-positioned wicking material 610 can be associated with an alert indicating that first volume of water is detected, and the second, higher-positioned wicking material 610 can be associated with an alert indicated that a second, greater volume of water is detected. If the second, higher-positioned wicking material 610 detects water, the controller of the water heater 500 can be configured to disable operation of the water heater 500 and/or close a valve (e.g., an inlet valve) to prevent further ingress of water into the water heater 500. Similarly, in configurations in which a single wicking material 610 is included, the controller can be configured to output an alert, disable operation of the water heater 500, and/or close a valve (e.g., an inlet valve) to prevent further ingress of water into the water heater 500.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

Moreover, the various diagrams and figures presented herein are for illustrative purposes and are not to be considered exhaustive. That is, the systems described herein can include one or more additional components, such as various valves, expansions tanks, and the like, as will be appreciated by one having ordinary skill in the art.

What is claimed is:

1. A leak detection system for a fluid heating device, the leak detection system comprising:

a bottom pan;

a structure having a pan shape and configured to at least partially insert into the bottom pan of a fluid heater;

a fluid removing portion disposed within the structure and comprising a wicking material, the fluid removing portion configured to transport water from the structure to at least one leak sensor; and the at least one leak sensor configured to detect the fluid transported from the structure by the fluid removing portion.

2. The leak detection system of claim 1, wherein the wicking material is in electric communication with the at least one leak sensor, and wherein the at least one leak sensor does not extend along a length of the wicking material.

3. The leak detection system of claim 1, wherein the wicking material forms a ring along a perimeter of the structure.

4. The leak detection system of claim 1, wherein the wicking material is flat.

5. The leak detection system of claim 1, wherein:

the structure comprises a port comprising one or more receptacles, and the leak detection system further comprises a plug having one or more prongs, each of the one or more prongs being configured to extend into a corresponding one of the one or more receptacles and contact the fluid removing portion, the plug being in electrical communication with the at least one leak sensor.

6. The leak detection system of claim 1, wherein the structure comprises one or more attachment structures configured to retain the fluid removing portion at a predetermined height.

7. The leak detection system of claim 1, wherein a top surface of a bottom of the structure slopes downwardly in a radially outward direction.

8. The leak detection system of claim 1, wherein the structure comprises an upwardly protruding mound located proximate a center of the structure.

9. The leak detection system of claim 1, wherein the structure comprises one or more apertures extending through a bottom of the structure, the one or more apertures configured to permit water to pass from an exterior surface of the bottom of the structure to an interior surface of the bottom of the structure.

10. The leak detection system of claim 1, wherein the fluid removing portion extends along an entire inner perimeter of the structure.

11. The leak detection system of claim 1, wherein the fluid removing portion is spaced apart from a bottom of the structure.

12. A leak detection system comprising:

a water removing portion configured to extend along at least some of a perimeter of a bottom pan of a water heater, the water removing portion configured to transport water from the at least some of the perimeter to at least one leak sensor;

an attachment structure configured to attach the water removing portion to the bottom pan, the attachment structure comprising a body and one or more prongs extending outwardly from a face of the body, the one or more prongs being configured to extend at partially into the water removing portion; and the at least one leak sensor configured to detect the water transported from the at least some of the perimeter by the water removing portion.

13. The leak detection system of claim 12, wherein the water removing portion extends along an entire inner perimeter of the bottom pan.

14. The leak detection system of claim 12, wherein the water removing portion extends along an entire outer perimeter of the bottom pan.

15. The leak detection system of claim 12, wherein each of the one or more prongs comprises a barb or a hook.

16. The leak detection system of claim 12, wherein the attachment structure further comprises a hole extending through the body.

* * * * *